United States Patent [19]

Jorgensen-Beck et al.

[11] 4,066,207

[45] Jan. 3, 1978

[54] DISPENSER CARTON BOXES

[75] Inventors: Frode Jorgensen-Beck; Heinrich Wilhelm Lambach, both of Horsens, Denmark

[73] Assignee: Brdr. Schur International A/S, J. W. Schursevej, Denmark

[21] Appl. No.: 707,082

[22] Filed: July 20, 1976

[51] Int. Cl.[2] ..... B65D 5/72

[52] U.S. Cl. ..... 229/17 SC; 229/7 SC

[58] Field of Search ..... 229/17 B, 17 M, 17 SC, 229/11, 7 SC, 19, 51 D; 206/539, 540, 532, 536; 222/162

[56] References Cited

U.S. PATENT DOCUMENTS

| | | | |
|---|---|---|---|
| 736,244 | 8/1903 | Gallo | 229/19 |
| 1,951,274 | 3/1934 | Denman | 229/7 SC |
| 2,067,723 | 1/1937 | Nahm et al. | 229/17 SC |
| 2,093,143 | 9/1937 | Bonner | 229/17 SC |
| 2,330,926 | 10/1943 | Rous | 229/17 SC |
| 3,610,410 | 10/1971 | Seeley | 229/11 X |
| 3,940,035 | 2/1976 | Huberli | 229/7 SC |

*Primary Examiner*—Davis T. Moorhead
*Attorney, Agent, or Firm*—Craig & Antonelli

[57] ABSTRACT

A sales and dispenser carton box having in its top panel a dispenser opening normally closed by an internal closing plate portion constituting an integral part of the blank from which the box is erected and being displaceable to open and close the opening, the closing plate being hinged to the free edge of an end panel portion of the box pivotally secured to the box along its opposite edge, and the closing plate being held slidingly against the inner side of the top panel by means of at least one side flap projecting from the side edge of the closing plate down along the respective side panel of the box so as to be slidingly supported by an elongated rigid portion of the box. The box may be designed so as to have a breakable seal.

57 Claims, 16 Drawing Figures

Figure 1:
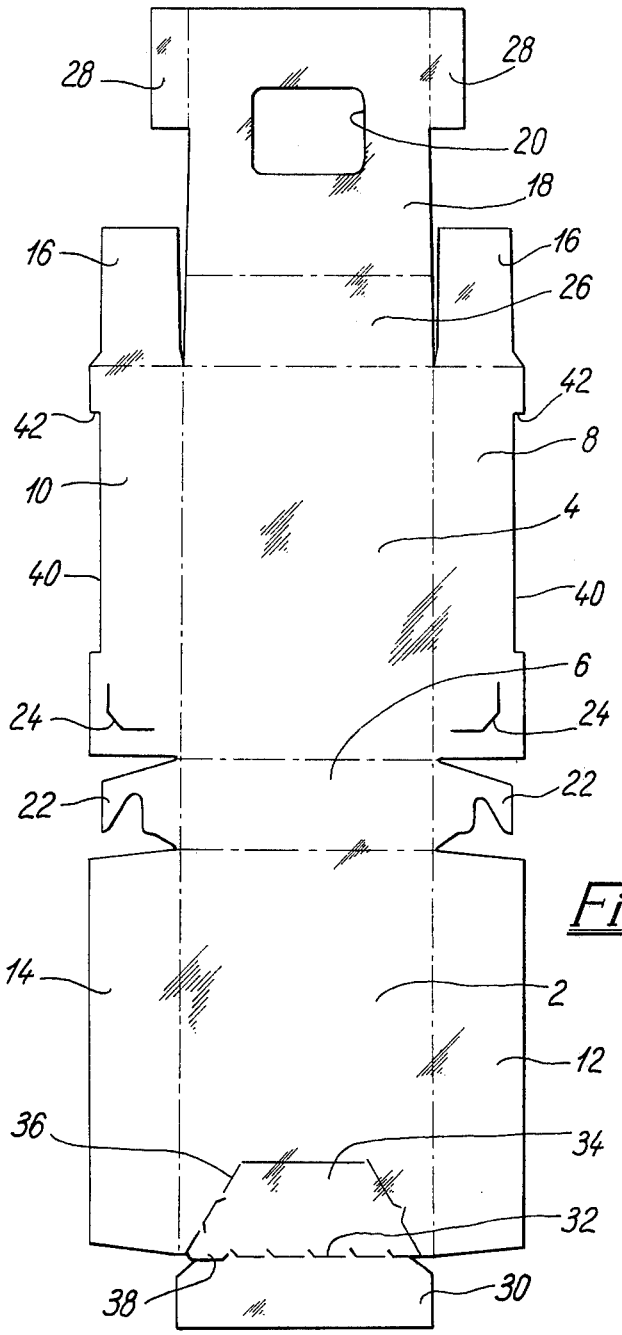

4
12'
30'
16
a
26
28"
27
20
2
b
18
10'
8'
L
7
6'
9
34
36

DISPENSER CARTON BOXES

The present invention relates to a sales and dispenser carton box having a top panel with a dispenser opening normally closed by a closing plate portion arranged generally inside the box, said closing plate portion being displaceable to open and close the dispenser opening. The outer edge of the closing plate portion is located outside the box and is connected with one edge of a box front end panel. The opposite edge of the box front end panel is hinged to a box bottom panel whereby said end panel may be pivoted so as to displace the closing plate for opening and closing the dispenser opening.

Boxes of this type may be used for pellets, drawing pins and the like and, since they may be opened and closed by the action of one's thumb, are operable by one hand. Due to the closing plate being linked to the box through the said front end panel the closing plate is guided so as to be resonably secured against edging by the one finger operation. Another advantage of the linked connection is that the closing plate may constitute an integral portion of the blank from which the box is erected.

It should be emphasized that the above terms "top panel", "bottom panel", and "front end panel" should, of course, in no way involve any limitation with respect to the orientation of dimensioning of the box. However, disclosure of applicant's invention will be highly facilitated if the box is generally looked upon in such a way that it has a top side in which the dispenser opening is provided and beneath which the closing plate is arranged so as to be operable from the front end of the box. The terms bottom-, side-, front and rear end panels should be defined with reference to the above statements.

Known boxes of the type referred to have been confronted with problems regarding the guiding of the closing plate for obtaining the contents of said boxes. Applicant's invention has alleviated this problem in that the closing plate portion inside the box is located reasonably flat against the lower side of the top panel, i.e. without taking up space in the box and without abutting the contents of the box by its opening and especially closing movement. Applicant's invention may also incorporate means preventing the closing plate portion from being retracted too far from the box.

It is the primary purpose of this invention to provide a box which is improved in these respects in a simple manner.

According to the invention at least one side edge portion of the closing plate is located near the adjacent side panel of the box and provided with a side flap which is folded down along said side panel and slidingly supported by an elongated carton portion so as to support the closing plate slidingly against or near to the inner or lower side of the top panel provided with said dispenser opening. In addition, said side flap or another corresponding side flap located at the opposite edge of the closing plate has a front edge facing the front end of the box which may cooperate with a rigid stop portion of the box so as to form a stop edge effectively limiting the forward opening movement of the closing plate. Since the side flap or flaps are located immediately adjacent to the side panels of the box the side flaps themselves will not interfere with the contents of the box by the movement of the closing plate. In addition, the side flaps are able to both support the closing plate and constitute stop means limiting the retraction of the closing plate. The side flaps are easily provided as integral portions of the carton blank, and, as it will appear from the following discussion the box may be designed so as to present additional advantages with respect to automatic erection, filling and closing and with respect to the provision of a seal guaranteeing that box has not been previously opened.

Figure 6:
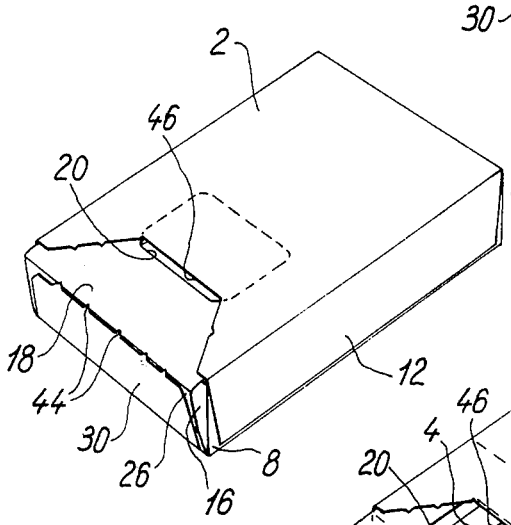
Figure 7:
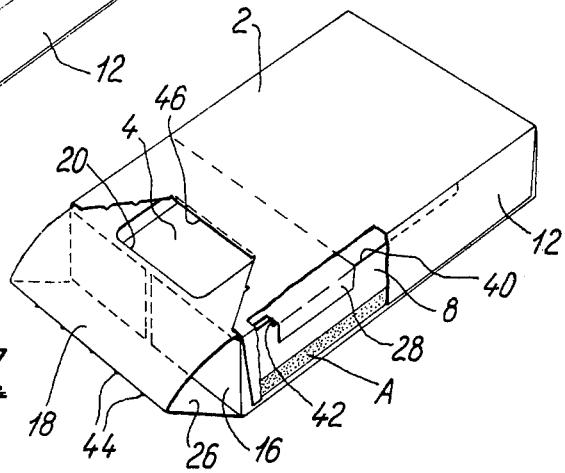
Figure 8:
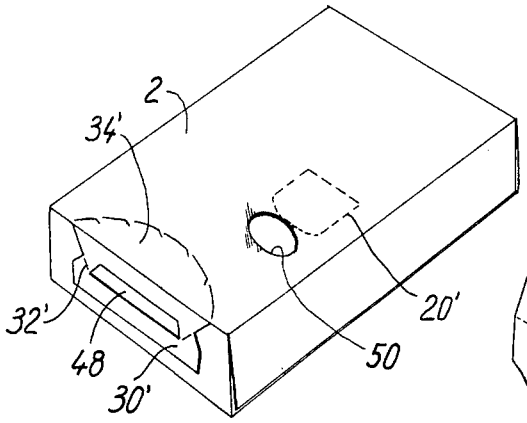
Figure 9:
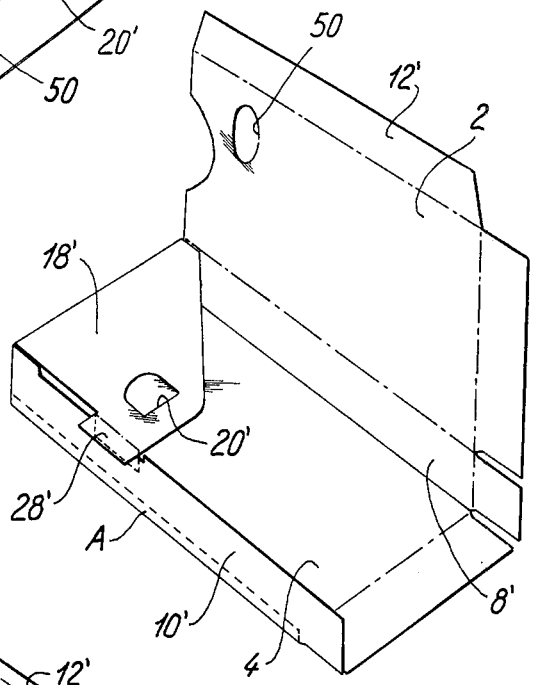
Figure 10:
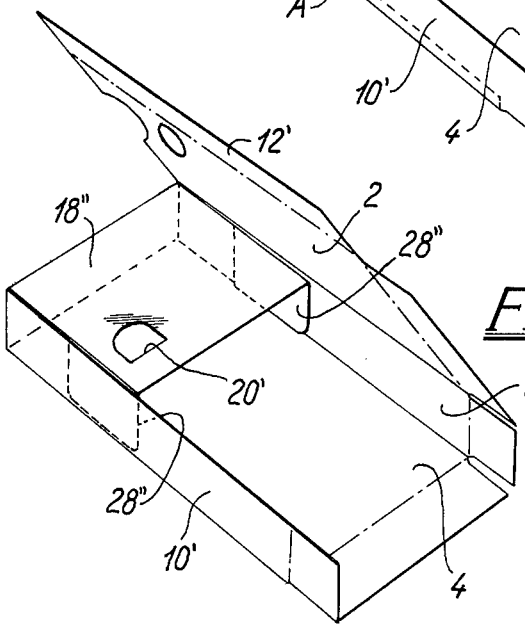
Figures 11, 12:
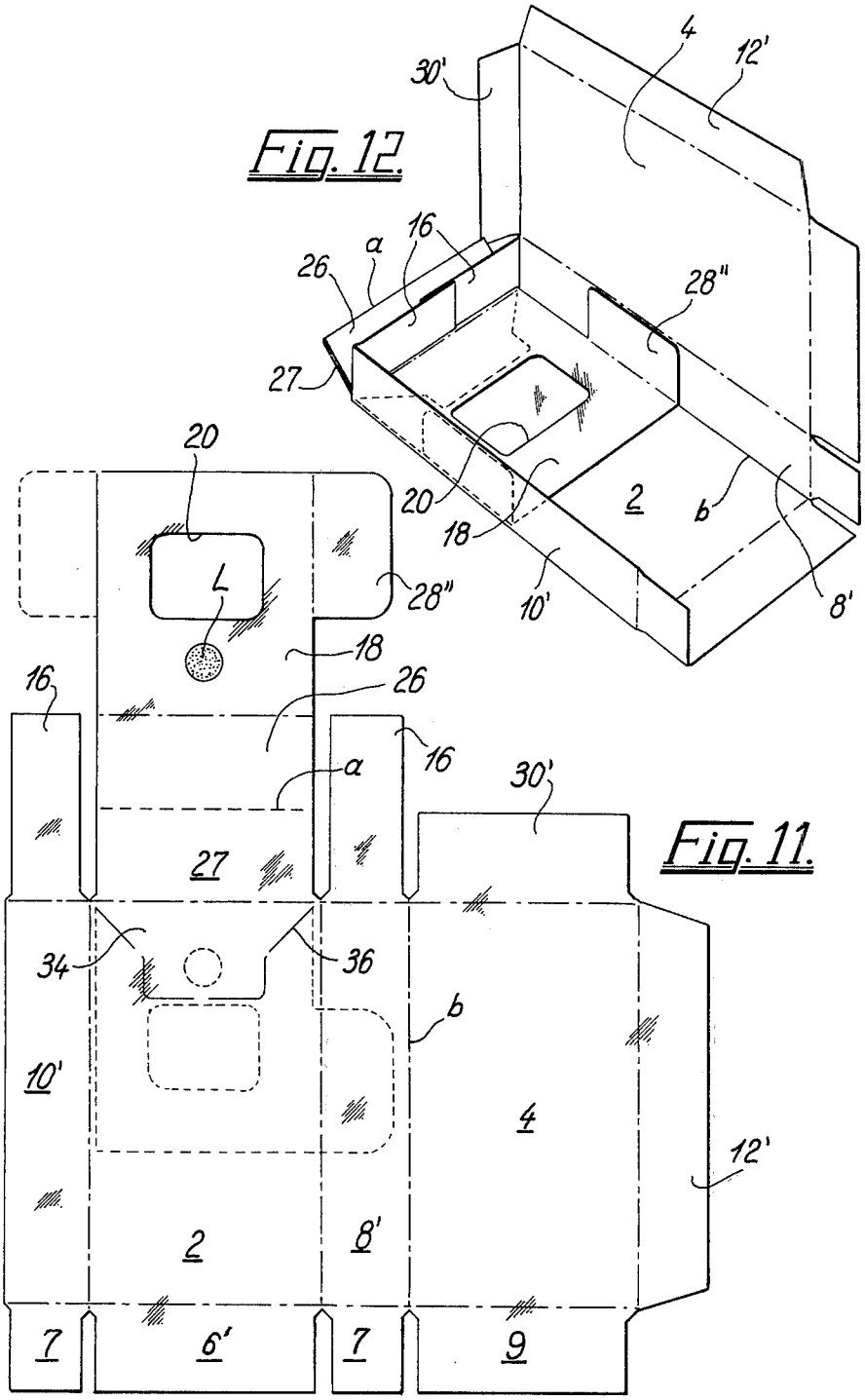
Figure 13:
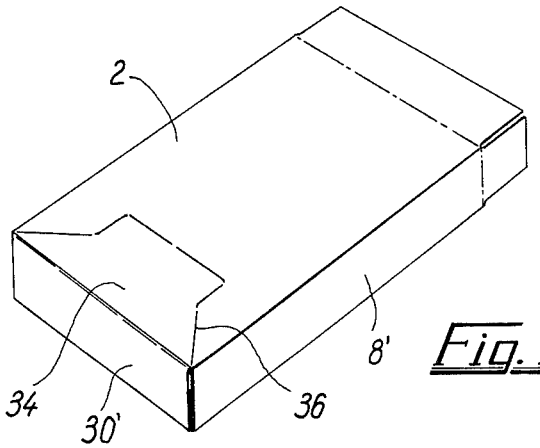
Figure 14:
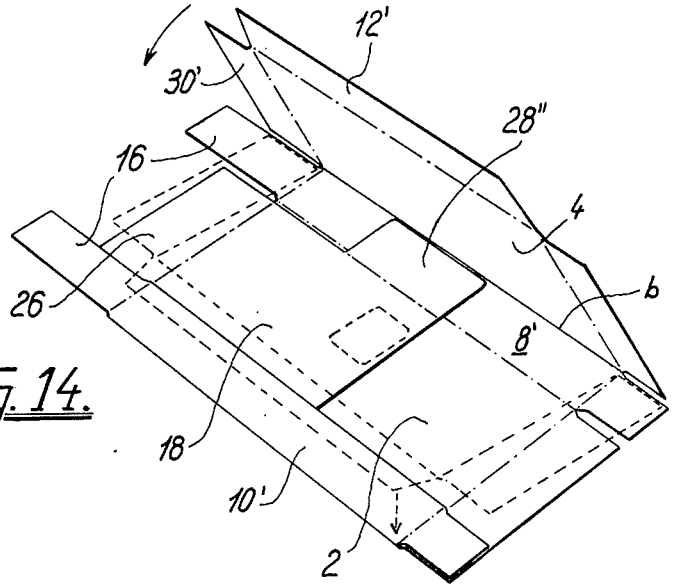
Figure 15:
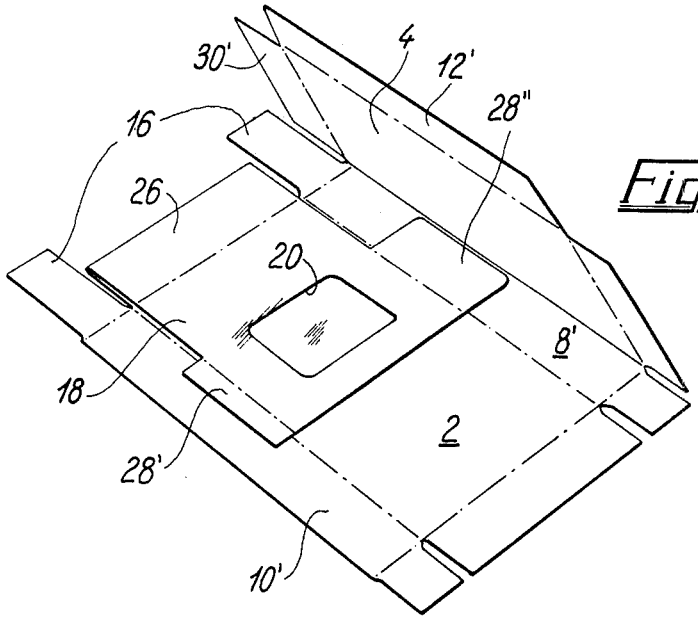
Figure 16:
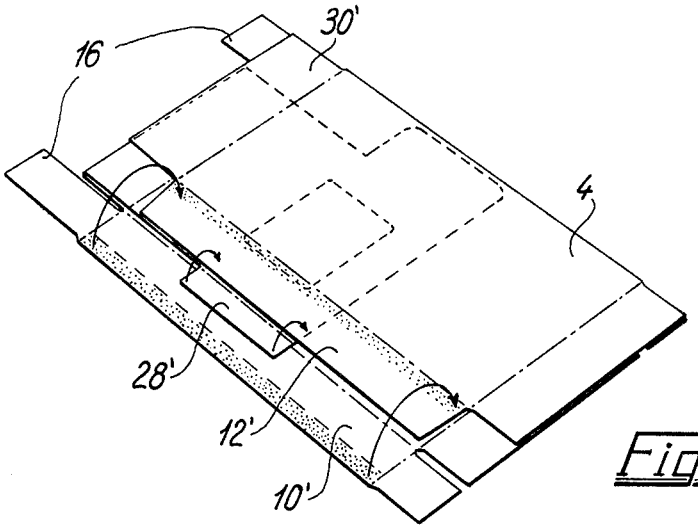

In the following discussion the invention is described in more detail with reference to the accompanying drawings, in which:

FIG. 1 is a plane view of a carton blank for a box according to a first embodiment of the invention, FIGS. 2–7 are perspective views illustrating various steps of erecting the box and opening the filled and closed box, FIG. 8 is a perspective view of a closed box according to a second embodiment of the invention, FIGS. 9 and 10 are perspective views of a third and fourth embodiment, respectively, shown in partly erected positions, FIG. 11 is a plane view of a blank for a box according to a fifth embodiment of the invention, FIGS. 12–14 are perspective views of this blank in various conditions of erection, and FIGS. 15 and 16 are perspective views illustrating a box member according to still a further embodiment of the invention.

The carton blank shown in FIG. 1 comprises a top panel 2, a bottom panel 4, a rear end panel 6, two inner side panels 8 and 10, two outer side panels 12 and 14, two front end flaps both designated 16, and a closing plate 18 having a hole 20. The rear end panel 6 is provided with two corner lock flaps 22 adapted in a well known manner to cooperate with locking slots 24 in the inner side panels 8 and 10. The closing plate 18 is hinged to the bottom panel 4 through a front end panel 26, and adjacent its outer end the closing plate 18 is at both sides provided with side flaps 28, the cross dimensions of which are smaller than the cross dimensions of the side panels 8–14. Adjacent its free end the top panel 2 has a projecting outer front end panel 30, and while there is provided folding lines between the other respective panel and flap portions as indicated by dot-and-dash lines, there is between the top panel 2 and the outer front end panel 30 provided a perforation line 32. In the outer end portion of the top panel 2 is defined a tear off portion 34 to be torn off along a further perforation line 36. In the lower left hand corner of FIG. 1 it is illustrated that the tear off portion 34 has a gripping flap 38 to be described below. The outer edges of the inner side panels 8 and 10 are each provided with a recess 40 having a front limit edge 42 at the recess end which faces the closing plate 18.

Figure 2:
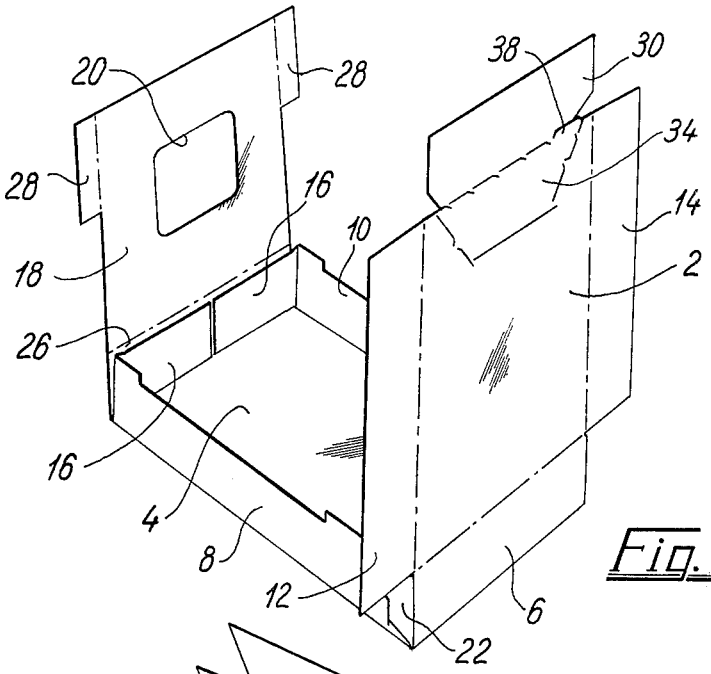

The box is erected from the blank first as shown in FIG. 2, where all the side and end panels of the bottom panel 4 are folded up and locked, partly by a well known locking engagement between the corner lock flaps 22 and the locking slots 24 in the inner side panels 8 and 10 and partly by folding in the front end panel flaps 16 and folding up the front end panel 26 and the closing plate 18, without the portions 16 and 26 being glued or otherwise joined to each other. In this position the box member is ready to pass a filling device (not shown) filling the box with the desired contents.

Figure 3:
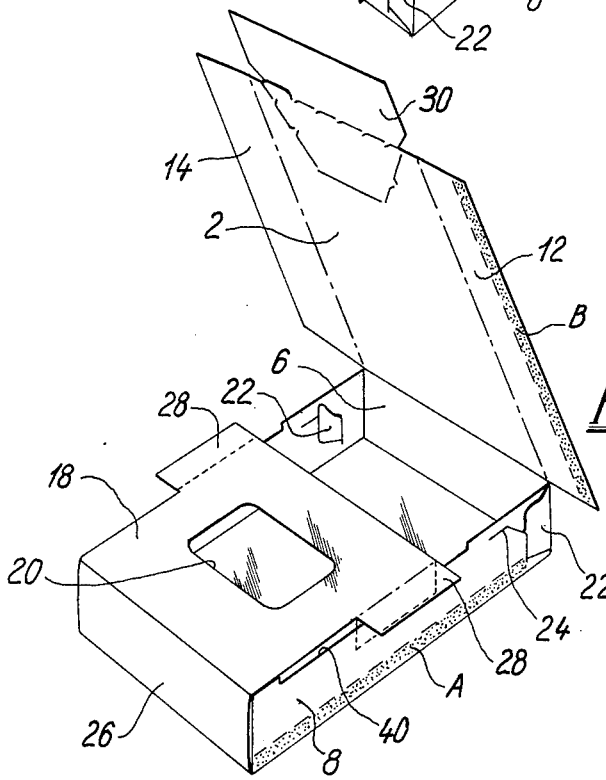
Figure 4:
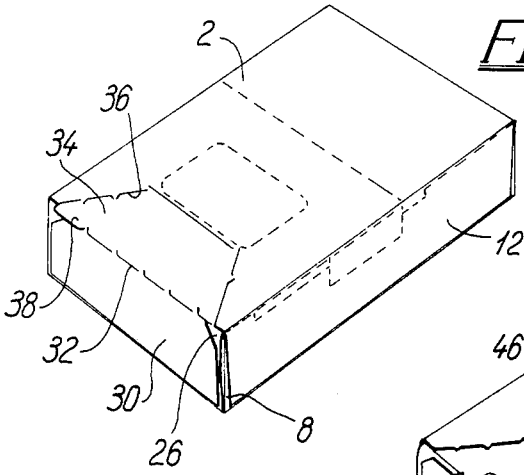

Thereafter the box member is brought to pass through a box closing station which in a manner not shown but otherwise elementary to those skilled in the art, operates to fold down the closing plate 18 over the filled box, see FIG. 3, and thereafter to fold down the top panel 2. Finally the outer side panels 12 and 14 and the outer front end panel 30 projecting from the top panel 4 are folded down along the box sides and joined, by gluing or other means such as by heat sealing to the respective inner side panels 8 and 10 and the front end panel 26, whereby the box is brought into a closed position as shown in FIG. 4. The projecting side flaps 28, FIG. 3, will automatically be folded down about the top edges of the respective side panels 8 and 10 when the outer side panels 12 and 14 on the top portion 2 are folded down.

By the joining of the respective side panels care should be taken that the joining is effected only along a lower area of the inner side panels 8 and 10, underneath the lower edge of the folded down side flaps 28, so as to ensure that the downwardly projecting side flaps 28 are movable longitudinally in the upper space between the inner and outer side flaps respectively. Thus, in case of gluing, glue should be supplied only along the area A or the area B indicated in FIG. 3.

In the closed box, FIG. 4, despite the mobility of the side flaps 28, the closing plate portion 18 is locked against displacement by virtue of the outer front end panel 30 of the top panel 2 being secured to the front side of the front end panel 26, i.e. the box is closed in a sealed manner.

Figure 5:
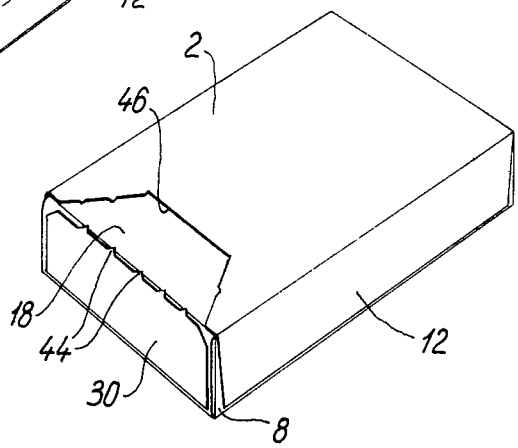

When it is desired to open the box the gripping flap 38 which projects slightly from the front top edge of the box is gripped and the entire tear off portion 34 between the perforation lines 32 and 36 is torn off, leaving a dispenser opening in the top panel 2 which is normally closed by the closing plate 18 as illustrated in FIG. 5. Along the upper front edge thereof remain carton protrusions 44. This flap now constitutes a passive portion joined to the front end panel 26. By the removal of the tear off portion 34 thereby creating a dispenser opening the top side of the front portion of the closing plate 18 is exposed. It is now possible by means of a thumb to push the closing plate 18 partially out of the box whereby the interior of the box is exposed. The protrusions 44 may serve to facilitate the pushing engagement.

In FIG. 6 the box is shown by initial opening in which the front edge of the hole 20 in the closing plate 18 has just appeared in front of the edge portion 46 which by the removal of the tear off portion 34 has formed a dispenser opening on the top panel 2. The front end panel 26 correspondingly has started swinging outwardly about the lower box front edge. In FIG. 7 the box is shown in fully opened condition in which the entire dispenser opening has been cleared by or almost the entire hole 20 so that the interior of the box is exposed in front of the said top edge portion 46. Thereafter any desired portion of the contents of the box may be poured out through the hole 20. The side flaps 28 on the closing plate 18 have been moved so far forwardly along the recess edge 40 that their front ends abut the front limit edges 42 so as to clearly indicate full opening of the box and prevent excessive retraction of the closing plate from the box. The box is reclosed simply by a light inward push on the outer edge of the front end panel 26.

It will be appreciated that the closing plate 18 inside the box is supported closely underneath the top panel 2 by means of the side flaps 28 and that these flaps, in conjunction with the recess front limit edge 42, form a retraction stop for the closing plate 18. The tear off portion 34 constitutes a guarantee seal after filling and closing of the box. This embodiment is well suited for automated erection, filling and closing as described.

The sealed closing of the box is obtainable without the use of the outer front end panel 30, since alternatively the tear off portion 34 may be joined to the underlying portion of the closing plate 18 by means of a spot of glue. To open the box it will then be necessary either to tear off the portion 34 along the perforation line 36, breaking the said glue or other connection between the portions 34 and 18, or by exerting a vertical pressure along the perforation line 36 in order to release the portion 34 from its connection with the top panel 2, whereafter the box may be opened with the portion 34 remaining joined with the closing plate 18. If the box is not to be closed in a sealed manner the blank may be designed without the flap portion 30 and the tear off portion 34. As shown in FIG. 5, except for the presence of the passive panel portion 30.

When the outer front end panel 30 is present the perforation line 32 may be located on this flap as shown in FIG. 8. The outer front end panel 30' is provided with a slot 48, the upper edge of which serves as a gripping edge for tearing off the portion 34' together with the adjoining upper portion of the outer front end panel 30'. FIG. 8 additionally illustrates that the hole 20' in the closing plate may be located so as to cooperate with a special dispenser opening 50 in the top panel 2.

FIG. 9 shows a modified embodiment in which the top panel 2 is hinged to a side edge of the bottom panel 4 through a side panel 8', and in which the closing plate 18' is monolaterally supported by means of a single side flap 28'. Upon folding down of the top panel 2 and further folding down of the outer side panel 12' thereof to be joined to the inner side panel 10' along the lower area A the box member thus folded may be filled through its open rear end which may thereafter be closed in any conventional manner. The box of FIG. 9 is not provided with guarantee closure means, but of course it may have such means just as the boxes according to FIGS. 1–8. A side flap folded down from a side edge portion of the closing plate may be used for supporting the closing plate 18'' instead of the closing plate itself being supported on the top edge of the inner side panel 8',10', viz. by extending, inside the box, down to the bottom panel 4 as illustrated in FIG. 10 in which the side flaps are designated 28''. It is readily seen that these side flaps 28'' provide full and sliding support for the closing panel 18'' by slidingly engaging the outer edge area of the bottom panel 4, and that moreover they will form a retraction stop for the closing plate by their edges facing the box front end abutting the inner side of the front end panel of the box when the closing plate is fully retracted. Also in this embodiment the side flaps 28'' are located immediately adjacent the side panels of the box, whereby they are movable without interfering with the contents of the box.

It will be readily understood that even the box according to FIGS. 1–7 might alternatively be provided with bottom supported side flaps 28' as in FIG. 10, instead of the narrow side flaps 28, whereby the edge recess 40 would be superfluous. However, by rapid automatic handling of the box members for erecting, filling and closing thereof it maybe difficult to fold the relatively broad side flaps 28'' and guide them into the position inside the box as shown in FIG. 10 by the folding down of the closing plate 18. It is possible, however, to design the box so as to avoid these problems, and such a box is illustrated in FIGS. 11–13 in which for similar box portions there is used the same reference numerals as in FIGS. 1 and 10, respectively.

The box blank shown in FIG. 11 has its bottom panel 4 hinged to the side of the top panel 2 through a side panel 8', and the closing plate 18 with the closing plate end panel 26 projects from the front end panel portion 27 which has the same dimensions as closing plate end panel 26 said front end panel is connected to the front edge of the top panel 2. The front end portion of the top panel 2 is provided with the perforation line 36. Preparatory to the erection of the box the closing plate 18 and the closing plate end panel 26 as a whole are folded along folding line "a" between the panel portions 26 and 27 and are laid plane against the inside surface of box top panel 2 and front end panel 27 as shown in dotted lines, a glue spot L being applied for securing the closing plate to the top panel 2 in the area inside the perforation line 36. Alternatively the same joining may be obtained by heat sealing if the blank is prepared accordingly. Thereafter the blank is partially erected as shown in FIG. 12, with the top panel 2 temporarily constituting the bottom of the box member. When the side panels 8' and 10' are folded upwardly the side flaps 28'' of the closing plate will automatically be folded up to a position inside the box member. With the folding of the end panels 26 and 27, the rear end flaps 7 and rear panels 6' and 9 in a well known manner, the box member may be filled and thereafter closed by folding down the bottom panel 4 and by further folding down the side and end flaps thereof and joining these to the respective exterior sides of the lower part of the box member. By the initial erection the front end panel flaps 16 are folded inwardly and the doubled end panel portion 26, 27 is folded upwardly against the exterior side of the front end panel flap 16 without being secured thereto, while by the final closing the front end flap 30' is joined to the exterior side of the doubled panel 26, 27 by gluing or otherwise. Alternatively the box may be erected to the position shown in FIG. 13 in which the rear end flaps and panels are not closed, whereby the box may be filled through the rear end and thereafter finally closed.

For opening the box it is sufficient to break the perforation line 36 by a vertical pressure on the panel portion 34, whereafter the box can be opened and closed just as described above, the closing plate 18 being retractable by pivoting the doubled end flap 26, 27 and the associated front end flap 30'. The panel portion 34 outlined by the perforation line 36 remains joined to the top side of the closing plate 18.

In FIG. 11 it is indicated by a dotted line that it may be possible to avoid the side flap 28'' at one side of the closing plate 18, this being of relevance in connection with the embodiments described in the following.

According to the invention it is a special possibility that the blank folded according to FIG. 11 may be pre-folded into a flat tubular shape by folding the side panel 10' flat against the inside surface of box top panel 2 as shown in FIG. 14 and thereafter folding the bottom panel 4 about the folding line "*b*" between this panel and the side panel 8' such that side panel 12' lays flat against side panel 10' without the folding of the various end flaps. In this embodiment of the invention the blank may be pre-folded in the box factory into said flat tubular shape with the outer side panel 12' of the bottom panel 4 secured to the inner side panel 10'. In the filling factory it will then be sufficient to erect the box member into a tubular shape, close one end thereof, fill it through the opposite end and finally close this opposite end.

By the erection of the flat box member according to FIG. 14 the visible side flap 28'' will be folded in such a manner that its natural resiliency will force against the erected side panel 8' and thus present no risk of engagement with the contents of the box. At the opposite side of the box member a corresponding side flap 28'', if used and if therewith already folded flat against the closing plate 18, would be liable to remain in its folded condition so as to not entirely follow the erection of the side panel 10', i.e. it would be liable to extend into the space inside the erected box, whereby it might engage the contents of the box by the movements of the closing plate, and for this reason it may be desirable to entirely avoid the side flap at this edge of the closing plate.

FIG. 14 moreover serves to illustrate that the closing plate 18 should not necessarily have a hole for cooperating with the dispenser opening of the top panel 2, since it may be sufficient that the free edge of the closing plate may cover and uncover an outlet opening in the top panel 2 or the edge of such an opening.

As already mentioned it would not be too advantageous to provide the closing plate 18 of FIG. 14 with side flaps 28'' at both sides, since such a flap underneath the sharply folded side panel 10' would be difficult to re-erect entirely when the tubular member is erected later on. In the embodiment shown it is for natural reasons not possible to use an edge supported flap 28, FIG. 1, or 28', FIG. 9 but such use is enabled by another manner of folding the blank, illustrated in FIGS. 15 and 16. In this embodiment a narrow side flap 28' is added opposite to the flap 28'', and in the folding the second operation is to fold the bottom panel 4, whereby the flap 28' as shown in FIG. 16 will be located projecting from the outer edge of the side panel 12'. Thereafter the side panel 10' is folded as indicated by arrows and secured to the top side of the panel 12' along its outer edge portion. By this folding the flap 28' will be folded in a compulsory manner as also indicated by arrows, and it will remain non-joined to the adjacent carton portions. The box member now assumes its prefolded flat tubular shape from which it will later be erected in the filling plant. In this erection the flap 28'' will be compulsorily folded just as in FIG. 14. Also the flap 28' will be folded in a compulsory manner, because it is interposed between the side panels 10' and 12'. It is readily seen that irrespective of the tendency of flap 28' to re-fold into the box it will remain in its position corresponding to FIG. 7. FIGS. 15 and 16 additionally serve to illustrate that the flap 28' should not necessarily cooperate with a recess in the edge of the side panel 12', as the flap 28'' forms a retraction stop for the closing plate.

What is claimed is:

1. A sales and dispenser carton box having a top panel with a dispenser opening normally closed by a closing plate portion arranged generally inside the box and being displaceable to open and close the dispenser opening, said closing plate portion having an outer edge located outside the box and connected with one edge of a box front end panel, the opposite edge of which is hinged to a box bottom panel whereby the front end panel may be pivoted so as to displace the closing plate for opening and closing the dispenser opening, characterized in that at least one side edge portion of the closing plate is located near the adjacent side panel of the box and provided with a side flap which is folded down along said side panel and slidingly supported by an elongated carton portion so as to support the closing plate slidingly against or near to the inner or lower side of the top panel provided with said dispenser opening, while said side flap or another corresponding side flap located e.g. at the opposite edge of the closing plate has a front edge facing the front end of the box and cooperating with a rigid stop portion of the box so as to form a stop edge effectively limiting the forward opening movement of the closing plate.

2. A box according to claim 1, in which the closing plate is provided with said side flaps at both sides, and in which both side flaps serve to support the closing plate as well as to form said stop edge.

3. A box according to claim 1, in which the side flap is bent downwardly over the top edge of an inner side panel portion folded up from the bottom panel of the box, the side flap projecting only partially down along the outside of the inner side panel portion being covered by an outer side panel portion folded down from a side edge of said top panel, said outer side panel portion being fastened to the inner panel portion outside the area through which the side flap is moved when the closing plate is displaced between open and closed position.

4. A box according to claim 3, in which the top edge of the inner side panel portion is provided with an elongated recess along which the side flap is slidable, the front end edge of said recess forming said stop portion cooperating with the stop edge of the side flap to limit the opening movement of the closing plate.

5. A box according to claim 1, in which the side flap is folded down along the interior side of the adjacent side panel of the box and projects to the bottom panel so as to have its lower edge slidingly supported by the outer edge area of the bottom panel.

6. A box according to claim 5, in which the front end of the side flap facing the box front end constitutes the stop edge for limiting the opening movement of the closing plate by cooperation with the outermost inner side portion of a rigid, interior end panel located inside the pivotable front end panel associated with the closing plate.

7. A box according to claim 1, in which an outer front end panel of the top panel is folded down along the pivotal box front end panel and fastened thereto, a perforation line or a tear-off portion being provided across the box between said outer front end panel and said top panel, whereby a breakable guarantee seal is provided.

8. A box according to claim 7, in which the perforation line or tear-off portion is located adjacent the front end of the top panel, spaced from the front edge thereof, so as to define an edge of said dispenser opening when broken or torn off.

9. A box according to claim 1, in which the closing plate is an endwise extension of the top panel folded so as to define a double layer front end panel and continuing rearwardly in the box as said closing plate, the exterior layer of said front end panel being connected with the top panel through a transverse perforation line or tear-off portion and being covered by and fastened to a front end flap portion folded up from the bottom panel.

10. A box according to claim 9, in which the side flap of the closing plate adjacent said side panel interconnecting the top and bottom panels is folded down along the interior side of the adjacent side panel of the box and projects to the bottom panel so as to have its lower edge slidingly supported by the outer edge of the bottom panel.

11. A box according to claim 10, in which an additional side flap is provided at the opposite side of the closing plate, this side flap projecting only partially down along the outside of the inner side panel covered by an outer side panel portion folded down from a side edge of said top panel, said outer side panel portion fastened to the inner panel portion outside the area through which the side flap is moved when the closing plate is displaced between the open and closed positions.

12. A box according to claim 1, in which the side flap is adjacent to the outer side of the adjacent inner side panel.

13. A box according to claim 1, in which the side flap is adjacent to the inner side of the adjacent inner side panel.

14. A box according to claim 2, in which the side flaps are bent downwardly over the top edge of their respective inner side panel folded up from the bottom panel of the box, each side flap projecting only partially down along the outside of the adjacent inner side panel, each side flap and inner side panel being covered by the respective outer side panel folded from a side edge of said top panel, said outer side panel being fastened to the inner side panel outside the area through which the side flaps move when the closing plate is displaced between the open and closed position.

15. A box according to claim 2, in which the side flaps are folded down along the interior side of the adjacent side panel and project to the bottom panel so as to have their lower edges slidingly supported by the outer edge area of the interior of the bottom panel.

16. A box according to claim 6, in which an additional side flap is provided at the opposite side of the closing plate, this side flap projecting only partially down along the outside of the interior side panel covered by an outer side panel folded down from side edge of said top panel, said outer side panel fastened to the inner side panel outside the area through which the side flap is moved when the closing plate is displaced between the open and closed position.

17. A box according to claim 11, in which the top edge of the inner side panel adjacent to the additional side flap is provided with an elongated recess along which the additional side flap is slidable, a front edge of said elongated recess cooperating with a front edge of the additional side flap to limit the opening movement of the closing plate.

18. A box according to claim 14, in which the top edges of the inner side panels are each provided with an elongated recess along which the adjacent side flap is slidable, a front edge of each recess cooperating with a front edge of the adjacent side flap to limit the opening movement of the closing plate.

19. A box according to claim 15, in which a front end of the side flap facing the box front end constitutes a stop edge for limiting the opening movement of the closing plate through cooperation with the outermost inner side portion of the front end flap located inside the pivotal front end panel associated with the closing plate.

20. A box according to claim 16, in which the top edge of the inner side panel adjacent to the additional side flap is provided with an elongated recess along which the additional side flap is slidable, a front edge of said elongated recess cooperating with a front edge of the additional side flap to limit the opening movement of the closing plate.

21. A box according to claim 17, in which the closing plate is provided with a hole which, upon movement of the closing plate, cooperates with the dispenser opening of the top panel.

22. A box according to claim 17, in which the dispenser opening of the top panel is a hole.

23. A box according to claim 21, in which the dispenser opening of the top panel is a hole.

24. A sales and dispenser carton box comprising:

a. a bottom panel;

b. two inner side panels;

c. a front end panel;

e. a rear end panel;

f. a closing plate;

g. at least one side flap;

h. a top panel provided with a dispenser opening;

i. two outer side panels; and j. means for joining the outer and inner side panels in such manner that the movement of the side flap is not retarded, said inner side panels being connected at opposite sides of said bottom panel in an upwardly perpendicular manner, said front and rear end panels each being connected at one of the remaining opposite sides of said bottom panel in an upwardly perpendicular manner, said closing plate being perpendicularly connected to said front end panel along the side of said front end panel opposite the side of said front end panel connected to said bottom panel in such manner that said closing plate is above and parallel to the bottom panel, said closing plate being provided with at least one side flap perpendicularly connected to said closing plate on a side of said closing plate adjacent to the side of said closing plate which is connected to the front end panel in such manner that the side flap is parallel and adjacent to said side flap's respective inner side panel so as to support the closing plate slidingly against or near to the inner side of a top panel, said top panel being perpendicularly connected to said rear end panel along the side of said rear end panel opposite the side of said rear end panel which is connected to said bottom panel in such manner that it is above and adjacent to said closing plate, said outer side panels being perpendicularly connected to said top panel in such manner that they are adjacent and may be joined to their respective inner side panels, said top panel being provided with a dispenser opening which may be opened and closed by the displacement of the closing plate.

25. A box according to claim 24, in which the side flap is adjacent to the outer side of the adjacent inner side panel.

26. A box according to claim 24, in which the side flap is adjacent to the inner side of the adjacent inner side panel.

27. A box according to claim 24, in which the closing plate is provided with a hole which, upon movement of the closing plate, cooperates with the dispenser opening of the top panel.

28. A box according to claim 24, in which the dispenser opening of the top panel is a hole.

29. A box according to claim 24, in which each inner side panel is provided with a front end flap perpendicularly connected to said inner side panel in such manner that the front end flaps are parallel and adjacent to the inner side of the front end panel.

30. A box according to claim 25, in which the closing plate is provided with a side flap at both sides of the closing plate adjacent to the side of the closing plate connected to the front end panel.

31. A box according to claim 25, in which the side flap projects only partially down along the outside of the adjacent inner side panel extending upward from the bottom panel and covered by the adjacent outer side panel, said outer side panel being fastened to the inner side panel outside of the area through which the adjacent side flap is moved when the closing plate is displaced between the open and closed position.

32. A box according to claim 26, in which the closing plate is provided with a side flap at both sides of the closing plate adjacent to the side of the closing plate connected to the front end panel.

33. A box according to claim 26, in which the side flap projects to the bottom panel so as to have its lower edge slidingly supported by the outer edge area of the inner side of the bottom panel.

34. A box according to claim 27, in which the dispenser opening of the top panel is a hole.

35. A box according to claim 29, in which the side flap is adjacent to the inner side of the adjacent inner side panel and cooperates with the respective front end flap to form stop means which limit the opening movement of the closing plate.

36. A box according to claim 29, in which the closing plate is provided with a side flap at both sides of the closing plate adjacent to the side of the closing plate connected to the front end panel, each side flap cooperating with its respective front end flap to form stop means which limit the opening movement of the closing plate.

37. A box according to claim 30, in which the side flaps project only partially down along the outside of the adjacent inner side panel extending upward from the bottom panel and covered by the respective outer side panel, said outer side panel being fastend to the inner side panel outside of the area through which the respective side flap is moved when the closing plate is displaced between the open and closed position.

38. A box according to claim 31, in which the top edge of the inner side panel adjacent the side flap is provided with an elongated recess along which the side flap is slidable, a front edge of the elongated recess cooperates with a forward edge of the side flap forming a stop means which limits the opening movement of the closing plate.

39. A box according to claim 32, in which the side flaps project to the bottom panel so as to have their lower edge slidingly supported by the outer edge area of the inner side of the bottom panel.

40. A box according to claim 33, in which an additional side flap is provided at the opposite side of the closing plate, this side flap projecting only partially down along the outside of the inner side panel covered by an outer side panel portion projecting down from the top panel, said outer side panel being fastened to the inner panel outside of the area through which the side flap is moved when the closing plate is displaced between the open and closed positions.

41. A box according to claim 35, in which an additional side flap is provided at the opposite side of the closing plate, this side flap projecting only partially down along the outside of the inner side panel covered by an outer side panel portion projecting down from the top panel, said outer side panel being fastened to the inner panel outside of the area through which the side flap is moved when the closing plate is displaced between the open and closed positions.

42. A box according to claim 37, in which the top edge of each inner side panel is provided with an elongated recess along which the adjacent side flap is slidable, a front edge of each elongated recess cooperating with a forward edge of each side flap forming stop means which limit the opening movement of the closing plate.

43. A box according to claim 39, in which an outer front end panel of the top panel projects down along the outer side of the box front end panel and is fastened thereto, a perforation line or tear-off portion being provided across the box between said outer front end panel and said top panel, whereby a breakable guarantee seal is provided.

44. A box according to claim 40, in which the top edge of the inner side panel adjacent to the additional side flap is provided with an elongated recess along which the additional side flap is slidable, a front edge of said elongated recess cooperating with a front edge of the additional side flap to form stop means limiting the opening movement of the closing plate.

45. A box according to claim 41, in which the top edge of the inner side panel adjacent to the additional side flap is provided with an elongated recess along which the additional side flap is slidable, a front edge of said elongated recess cooperating with a front edge of the additional side flap to form stop means limiting the opening movement of the closing plate.

46. A box according to claim 42, in which an outer front end panel of the top panel projects down along the outer side of the box front end panel and is fastened thereto, a perforation line or tear-off portion being provided across the box between said outer front end panel and said top panel, whereby a breakable guarantee seal is provided.

47. A box according to claim 43, in which the perforation line or tear-off portion is located adjacent the front end of the top panel, spaced from the front edge thereof, so as to define an edge of said dispenser opening when broken or torn off.

48. A box according to claim 45, in which an outer front end panel of the top panel projects down along the outer side of the box front end panel and is fastened thereto, a perforation line or tear-off portion being provided across the box between said outer front end panel and said top panel, whereby a breakble guarantee is provided.

49. A box according to claim 46, in which the perforation line or tear-off portion is located adjacent the front end of the top panel, spaced from the front edge thereof, so as to define an edge of said dispenser opening when broken or torn off.

50. A box according to claim 48, in which the perforation line or tear-off portion is located adjacent the front end of the top panel, spaced from the front edge thereof, so as to define an edge of said dispenser opening when broken or torn off.

51. A sales and dispenser carton box blank having a closing plate, an edge of which is connected with an edge of a front end panel, the opposite edge of said front end panel is connected to a bottom panel, the opposite edge of said bottom panel is connected to a rear end panel, the opposite edge of said rear end panel is connected to a top panel provided with a dispenser opening wherein said closing plate is provided with at least one side flap connected to said closing plate on a side of said closing plate adjacent to the side connecting the closing plate to the front end panel, said bottom panel is provided with two inner side panels connected to said bottom panel along the two bottom panel sides adjacent to said side connecting the bottom panel to the front end panel and said top panel is provided with two outer side panels connected to said top panel along the two top panel sides adjacent to said connecting the top panel to the rear end panel.

52. A blank according to claim 51, in which the inner side panels are each provided with a front end flap connected along the inner side panel edge which is a straight extension of the edge connecting the front end panel to the bottom panel.

53. A blank according to claim 51, in which the top panel dispenser opening is closed by a tear-off portion.

54. A blank according to claim 51, in which an inner side panel is provided with an elongated recess opposite the side of said inner side panel connecting said inner side panel to said bottom panel.

55. A blank according to claim 51, in which both inner side panels are provided with an elongated recess opposite the side of each inner side panel connecting each inner side panel to the bottom panel.

56. A blank according to claim 51, in which the closing plate is an end wise extention from the top panel, folded so as to define a double front end panel connected to said top panel through a transverse perforation line, said top panel being provided two inner side panels at either side adjacent to the side connected to the double layer front end panel, said bottom panel is connected to an inner side panel along a side opposite to said side connecting said inner side panel to said top panel, wherein said bottom panel is provided an outer side panel at the side opposite to the side connected to said inner side panel and a front end flap and rear end panel each connected to its respective remaining opposite side of said bottom panel, said top panel is provided a rear end panel connected along the side opposite the side of said top panel connected to said double layer front end flap and said inner side panels each being provided a front end panel flap and rear end flap at the opposing sides adjacent to the side of said inner side panel connected to said top panel.

57. A blank according to claim 53, in which the top panel is provided with an outer front end panel connected to said tear-off portion of said top panel dispenser opening.

* * * * *